United States Patent [19]

James

[11] Patent Number: 4,826,155

[45] Date of Patent: May 2, 1989

[54] ACCESSORY EQUIPMENT FOR EXERCISE APPARATUS

[76] Inventor: Laurence H. James, 166 Byram Shore Rd., Greenwich, Conn. 06830

[21] Appl. No.: 91,121

[22] Filed: Aug. 31, 1987

[51] Int. Cl.[4] ..... A63B 13/00

[52] U.S. Cl. ..... 272/123; 272/109

[58] Field of Search ..... 272/109, 117, 120, 123, 272/902; 128/70–75

[56] References Cited

U.S. PATENT DOCUMENTS

| | | | |
|---|---|---|---|
| 3,871,366 | 3/1975 | Cotrel | 128/75 |
| 4,125,257 | 11/1978 | Lew | 272/120 X |
| 4,324,398 | 4/1982 | Hole | 272/123 |
| 4,431,184 | 2/1984 | Lew et al. | 272/109 |
| 4,449,716 | 5/1984 | Goldy et al. | 272/109 |
| 4,531,727 | 7/1985 | Pitre | 272/117 |
| 4,634,118 | 1/1987 | Jensen | 272/120 X |
| 4,674,485 | 6/1987 | Swanson | 128/75 |
| 4,709,922 | 12/1987 | Slade, Jr. et al. | 272/123 |

*Primary Examiner*—Richard J. Apley
*Assistant Examiner*—Robert W. Bahr
*Attorney, Agent, or Firm*—Grimes & Battersby

[57] ABSTRACT

A frame structure defines an exercise station where exercises are practiced using barbell weights. The frame structure includes apparatus for hand-connecting a tackle assembly which is connected to a harness structure, the harness being secured about the chest of the exerciser, while the exerciser is in the exercise station. An attendant or spotter uses the tackle assembly to assist the exerciser in lifting weights during the exercise practiced, without physical contact with the weights and without interference with the exerciser in the practice of the exercise.

9 Claims, 3 Drawing Sheets

ACCESSORY EQUIPMENT FOR EXERCISE APPARATUS

BACKGROUND OF THE INVENTION

1. Field of the Invention

The present invention relates to exercise apparatus and in particular, accessory equipment used in conjunction with such exercise apparatus for assisting a person engaged in lifting and/or handling heavy weights used during a workout.

2. Description of the Prior Art

The use of weight training for the purpose of exercising and/or body development is well known. It has been found that muscular development, growth and strength can be enhanced by repeated high intensity exercise using progressively increased resistance so as to work muscles to a point of fatigue. When fatigue sets in the exerciser is no longer able to lift the weight to the initial position. As such point, the use of a second person or spotter may be required to assist the exerciser in removing the weights.

In performing such exercises, caution must be taken to insure that the exerciser will not lose control of the weights which may result in their falling upon and injuring and/or entrapping the exerciser.

Accessory weight control equipment connectable to the exercise apparatus has, heretofore, been used to prevent the fall of barbells or weights during such exercises. For the most part, however, such accessory weight control equipment is connected directly to the weights lifted by the exerciser and such equipment must be controlled by the exerciser who, ordinarily, is preoccupied with the task at hand i.e., lifting and controlling the weights and, therefore, pays little attention to controlling accessory equipment, which is an added responsibility.

Such accessory weight control equipment should meet certain conditions. First, it should not interfere with the exerciser during performance of the exercise, except in emergency situations. Second, the accessory weight control equipment must be able to recognize when interference with the exerciser is necessary and what action should be taken to assume control of the weight used in the exercise. These criteria require judgement which cannot normally be made by mere mechanical accessory equipment.

Because of such requirements, attendants, referred to as spotters are frequently used. Such spotters perform tasks that mechanical equipment cannot perform in that they are able to render assistance in the proper positioning and stance of the exerciser as well as being able to assist the exerciser during the workout when, and if, assistance is required.

One of the weight training exercises which requires spotters is the power squat exercise, where the exerciser uses relatively heavy weights and places such weights on his shoulders. Typically, the weights are free weights or barbells with the bar extending across the back of the neck and shoulders of the exerciser, with the weights being positioned on the outer ends of the bar. In performing the exercise power squat, the exerciser lowers his or her body by bending the knees and assumes a squatting position while maintaining the weight on the back of the neck and shoulders. During the exercise, the exerciser's back is maintained in a vertical position. Upon reaching a full squat, the exerciser then raises himself to a full standing position by straightening his legs, i.e. unbending his knees. This is repeated for a set number of repetitions.

The exercise power squat is recognized as an high intensity exercise, especially when the exerciser is practicing the exercise using a weight which is at or near the extremes of his capability to lower. It is well known that most athletes can lower a greater weight than the particular person can raise. It will be appreciated that when such exercise is practiced as an high intensity exercise, the exercise is quite difficult to perform. Normally assistance of one or more spotters is required to assist the exerciser in positioning the weights on the back of the neck and shoulders, prior to the exercise and in raising the weights from the squat position. Assistance is often needed when the exerciser tires.

SUMMARY OF THE INVENTION

The present invention, in brief summary, comprises exercise apparatus for assisting an exerciser to rise from a squatting position to a standing position while supporting barbell weights on his neck and shoulders. The apparatus includes a frame structure including first and second upright members in spaced relationship with each other, a crossbeam interconnecting the first and second upright members, and means coupled to the first and second upright members, respectively, for suspending apparatus for applying a lift assist force therefrom. The lift assist force applying apparatus includes a harness which includes coupling means for securing the harness about the chest of the exerciser, a block and tackle arrangement, which is coupled at one end to the means for suspending and is coupled at its opposite end to the harness. The block and tackle arrangement is operable by an attendant or spotter and is adapted to provide a lifting force which functions as a lift assistance to the exerciser while avoiding contact with the weights being used by the exerciser and applies such lift assistance without interfering with control over the weights by the exerciser.

It is therefore an object of the present invention to provide exercise apparatus which assists an exerciser in lifting weights and excludes accessory weight control equipment.

It is another object of the present invention to provide exercise apparatus which can be used to assist an exerciser in performing squatting exercises without contact with the weights or interfering with the exerciser in practice of the exercise.

It is yet another object of the present invention to provide such accessory lift applying equipment which permits a single spotter to assist the exerciser in raising and lowering weights without interfering with control over the weights by the exerciser.

It is still another object of the present invention to provide such accessory equipment which eliminates the need for more than one spotter during a power squat exercise.

It is yet still another object of the present invention to provide such accessory equipment which does not interfere with the exerciser in performing the exercise.

These and other objects will be more apparent from a review of the drawings and the detailed description of the preferred embodiment.

DETAILED DESCRIPTION OF THE INVENTION

Figure 1:
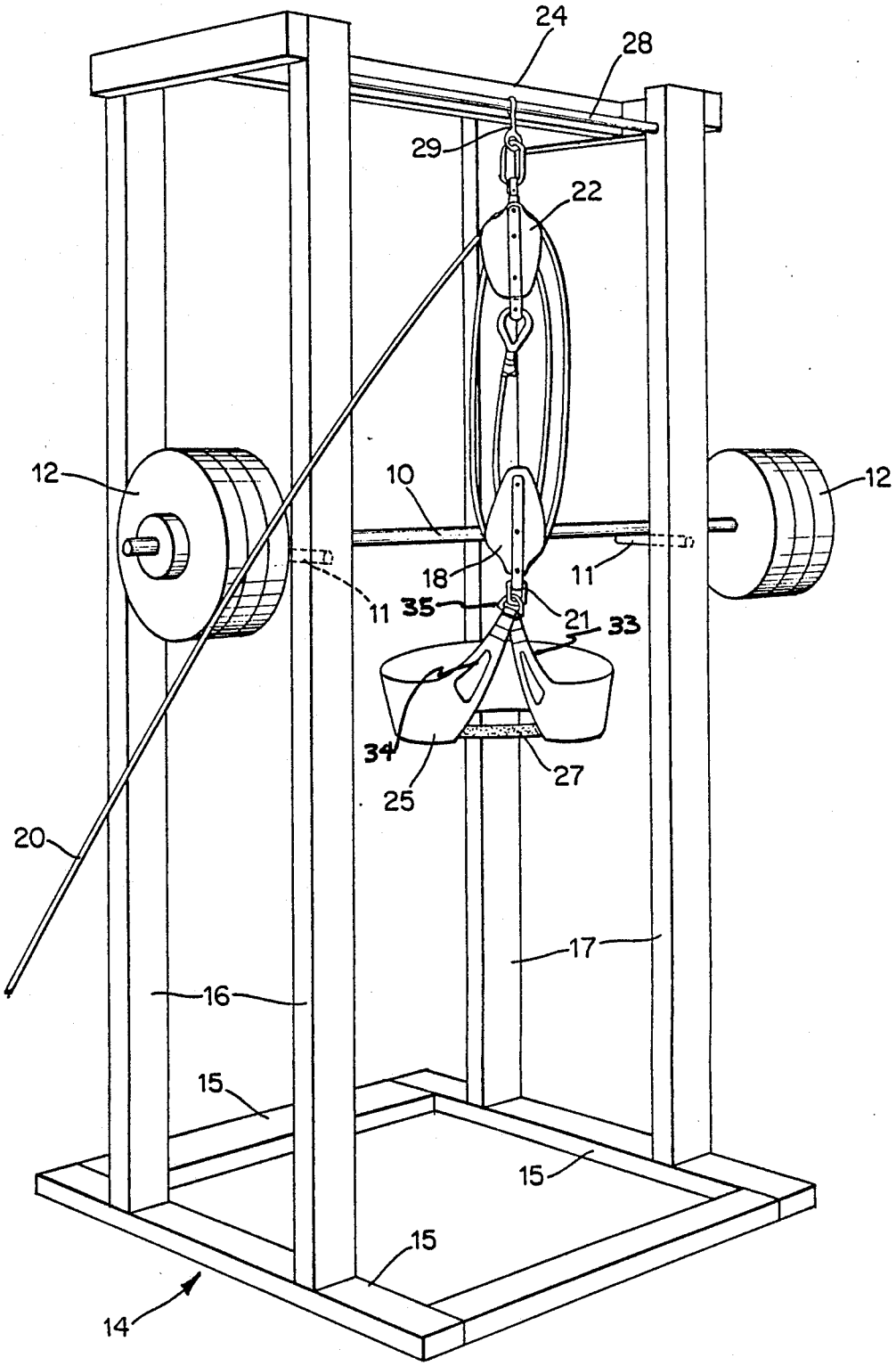
FIG. 1 is a perspective illustration of exercise apparatus which includes the accessory equipment of the present invention.

Referring now to FIG. 1, the accessory lift applying equipment of the present invention is shown used in conjunction with exercise apparatus of the type normally used to perform a power squat exercise. As shown, the exercise apparatus is a conventional weight rack. The weights used in such a weight rack comprises a typical barbell having at least a pair of weighted disks 12 at the outward ends of a bar 10. It will be appreciated that the weight of the barbells is adjustable by the addition or deletion of weighted disks 12.

Prior to practicing the exercise the barbells are supported in an elevated position on a frame 14 by the use of retaining pins 11. The frame 14, which essentially defines an exercise station, includes a two pair of upright members 16, 17 which are supported on a base 15. The upright members 16, 17 are spaced at the top of the exercise apparatus by a cross beam 24. The spacing between the upright members 16 and 17 is sufficiently wide to permit an exerciser to perform exercises within the confines of the frame 14 but narrow enough to permit the weight bar 10 to be capable of being supported on the pins 11 when not in use.

Figure 2:
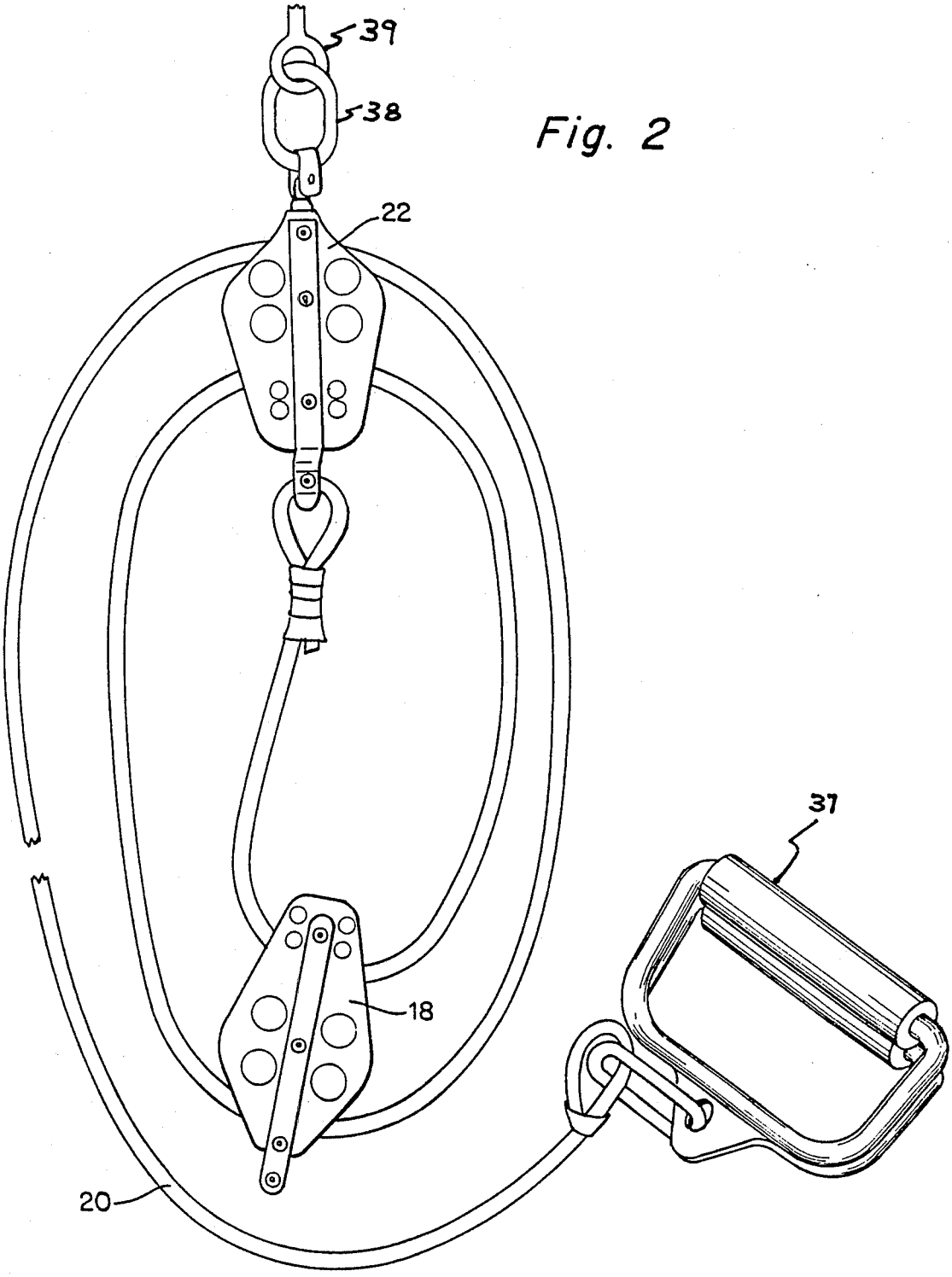
FIG. 2 is an enlarged view illustrating the block and tackle arrangement of the accessory lift applying equipment of the present invention.
Figure 3:
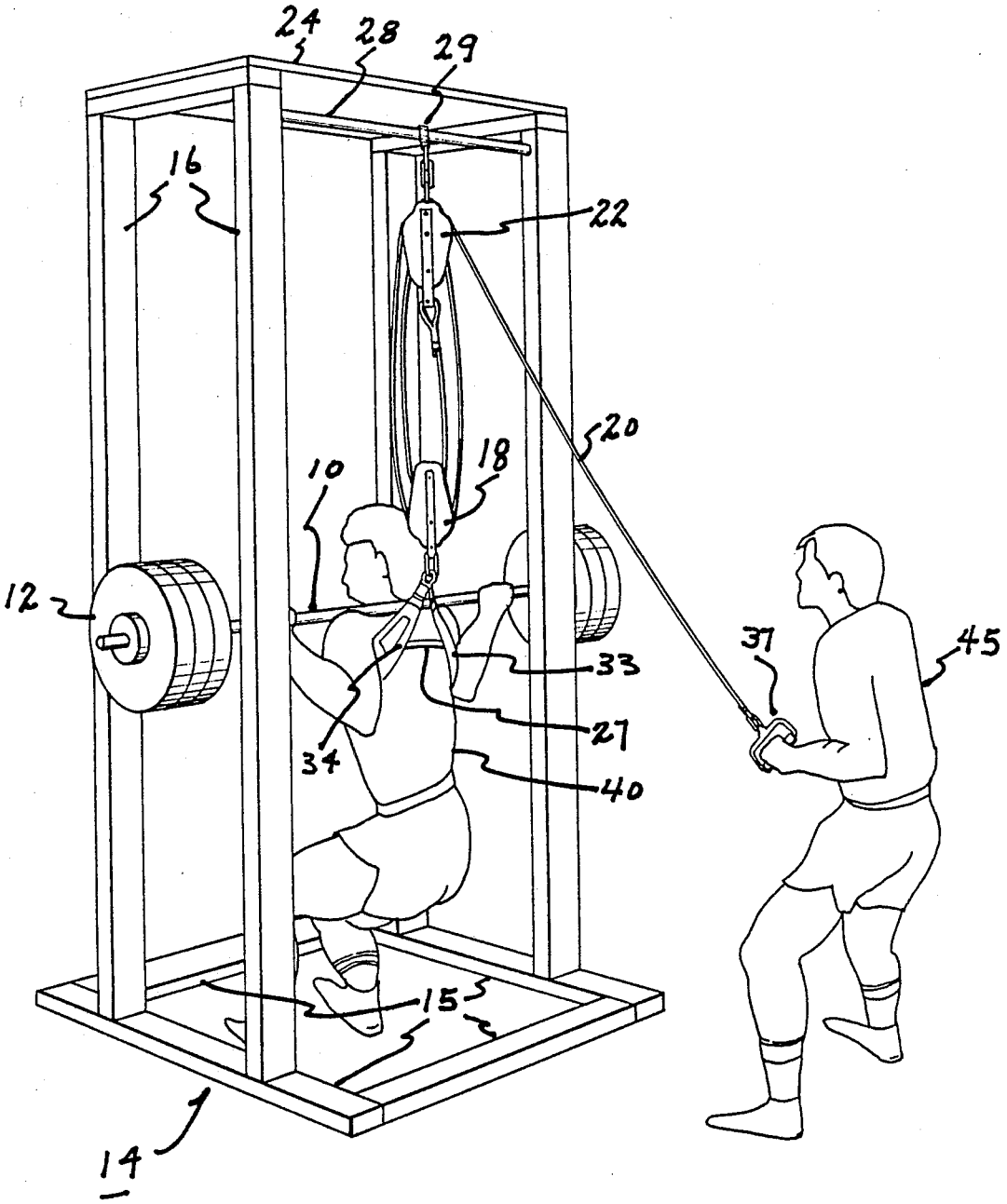
FIG. 3 is a perspective illustration showing the manner in which the exercise apparatus of the present invention may be used.

A bar 28 is also provided between the upright members 16,17 and also serves to support the accessory equipment of the present invention by a hook 29. The accessory equipment of the present invention comprises a block and tackle arrangement with an upper block assembly 22 and a lower block assembly 18. The upper block assembly 22 is preferably a dual pulley block assembly having upper and lower pulley wheels, not shown. The lower block assembly may be a single pulley block as shown in FIG. 1 but is preferably a double pulley wheel block as shown in FIGS. 2 and 3. A rope 20 is provided which, in FIG. 1 is shown secured to the eye of the lower block assembly 18. The rope 20 travels to the upper block assembly 22, passes around lower pulley wheel (not shown) of the upper block assembly 22, and then back to the lower block assembly 18 where it passes around a pulley wheel and then returns to the upper block assembly 22 where it passes over a upper pulley wheel (not shown). The outward end of the rope is capable of being held by a spotter as shown in FIG. 3.

A hook 21 is complete to the lower block assembly 18, the hook 21 being connected to a belt or harness 25, which is adapted to be secured around the chest of the exerciser by a closure 27. The closure 27 may be a VELCRO fastener closure or any other adjustable fastening device which can secure the belt or harness around the chest and back of an exerciser.

Attention is directed to FIG. 3 where an exerciser 40 is shown in a squatting position in the exercise station. An attendant or spotter 45, is also shown assisting the exerciser 40 in supporting the weights which are positioned across the back of the exerciser's neck and shoulders. The spotter 45 is using the apparatus of the present invention to assist the exerciser, with "hands-off" assistance in lifting the weights supported by the exerciser. The belt or harness 25 of the accessory equipment of the present invention is secured around the chest of the exerciser 40 by the closure 27, the belt or harness is hooked to a set of blocks coupled by rope 20.

In providing lift assistance to the exerciser, when assistance is required, the spotter 45 need only pull the rope 20 thereby closing the gap between the upper block assembly 22 and the lower block assembly 18, and thus assisting the exerciser 40 in raising the weights. As the gap between the two block assemblies 18, 22 is closed, a lifting force is applied to the exerciser through the harness 25. This lifting force or lift assistance effectively reduces the amount of weight the exerciser's legs need push up thus helping the exerciser assume a standing position. It will be appreciated that this block and tackle arrangement provides the spotter with a lifting advantage of at least a 2:1 lifting advantage and, in its preferred embodiment, a 4:1 lifting advantage.

As clearly seen in FIG. 1, the belt or harness 25 is a loop belt with wings 33 and 34 which pass through a "D" ring 35. The "D" ring 35 is hook connected to the hook 21 which is coupled to the lower pulley assembly 18. The closure 27 provides a means of securing the belt or harness 25 around the body of the exerciser, particularly about the chest, under the arms and across the back. This structure exerts a lifting force to the upper body of the exerciser when the rope 20 of the pulley assembly is pulled by the spotter. This lift force is coordinated with the exerciser's own forces, as respects the weights retained across the shoulders and back of the neck of the exerciser.

The closure 27 may be any adjustable closure, such as a buckle and strap end or other fastener system, such as the VELCRO fastener system, for example, which may secure the belt or harness about the body of the exerciser.

FIG. 2 illustrates the preferred block and tackle arrangement wherein the upper and lower pulley blocks 18 and 22 are double wheel pulleys. The upper pulley block 22 is secured to an adjustable ring 38 which passes through an eye 39. The eye 39 may be connected to the suspension bar 28 as an alternate suspension means, avoiding the use of the hook 29.

The rope 20 extends to the handle 37 for exerting a pulling force on the rope 20 for closing the gap or distance between the two block pulleys for applying the lifting force to the body of the exerciser in the exercise station.

Thus there has been disclosed exercise apparatus which includes accessory lift applying equipment adapted to be used by a spotter to assist the exerciser in raising and lowering the weights. Other changes and modifications, as will be apparent to those skilled in the art may be made without departing from the spirit of the invention.

Wherefore, I claim:

1. An exercise apparatus comprising:

(a) a frame having a pair of upright members in spaced relationship, an upper cross-beam connected to and separating said upright members, a base connected to and separating said upright members, and means for suspending accessory lifting apparatus from said upper cross-beam; and, (b) an accessory lifting apparatus suspendable from said upper cross-beam and adapted to provide a lifting force to an exerciser performing weight training exercises in said frame to assist said exerciser to rise from a squatting position to a standing position, said accessory lifting apparatus including:

(i) means for securing said accessory lifting apparatus to said means for suspending;

(ii) means for securing said accessory lifting apparatus to said exerciser; and (iii) a block and tackle arrangement, operable by a single spotter to said exerciser, for controlling said accessory lifting apparatus to apply a lifting force to the body of said exerciser to lift said exerciser from the squatting position to the standing position, wherein said block and tackle arrangement lies in a substantially vertical line between said spaced first and second upright members.

2. The exercise apparatus of claim 1, wherein said means for securing said accessory lifting apparatus to said exerciser comprises a harness adapted to be secured around the chest of the exerciser.

3. The exercise apparatus of claim 1, wherein said means for suspending includes a bar extending between said upright members which is adapted to receive said means for securing said accessory lifting device to said suspending means.

4. The exercise apparatus of claim 1, further comprising hanger means provided on each of said upright members for supporting a weight used in said weight training exercises.

5. The exercise apparatus of claim 1, wherein said block and tackle arrangement includes an upper block assembly, a lower block assembly, and a rope which is secured at one end thereof to said upper block assembly and which passes through said block and tackle arrangement and operable by an external spotter.

6. The exercise apparatus of claim 5, wherein said block and tackle arrangement is adapted to provide a lifting force to said harness which transfers said lifting force to said exerciser when the spotter draws the rope.

7. An exercise apparatus for assisting an exerciser to rise from a squatting position to a standing position while supporting barbell weights on his neck and shoulders, said apparatus including:

(a) a frame structure including at least first and second upright members in spaced relationship, a crossbeam interconnecting said first and second upright members, and means coupled to said first and second upright members, respectively, for suspending accessory lifting apparatus therefrom;

(b) a harness including coupling means for securing said harness about the chest of said exerciser; and, (c) a block and tackle arrangement coupled at one end to said means for suspending and coupled at its opposite end to said harness, said block and tackle arrangement being operable by a single spotter to said exerciser to provide lifting assistance to said exerciser to lift said exerciser from the squatting position to the standing position while avoiding contact with the weights supported on said exerciser, wherein said block and tackle arrangement lies in a substantially vertical line between said spaced first and second upright members, whereby the feet of said exerciser remain on a surface which supports said exerciser.

8. The exercise apparatus of claim 7, wherein said means for suspending includes a suspension bar mounted between said first and second upright members and wherein said block and tackle arrangement further includes hook means for coupling said arrangement to said suspension bar for suspending said block and tackle arrangement from said suspension bar.

9. The exercise apparatus of claim 8, wherein said block and tackle arrangement provides at least a 2:1 work advantage for the spotter.

* * * * *